US009463944B2

(12) United States Patent
Kenmotsu et al.

(10) Patent No.: US 9,463,944 B2
(45) Date of Patent: Oct. 11, 2016

(54) PAPER PROCESSING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Takahide Kenmotsu, Shizuoka (JP); Katsuhiko Tsuchiya, Shizuoka (JP); Ken Iguchi, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 136 days.

(21) Appl. No.: 14/554,740

(22) Filed: Nov. 26, 2014

(65) Prior Publication Data

US 2016/0144525 A1 May 26, 2016

(51) Int. Cl.

| | |
|---|---|
| ***B65H 35/02*** | (2006.01) |
| ***B26D 5/26*** | (2006.01) |
| ***B26F 1/00*** | (2006.01) |
| ***B65H 35/00*** | (2006.01) |

(52) U.S. Cl.

CPC ..... *B65H 35/02* (2013.01); *B26D 5/26* (2013.01); *B26F 1/0092* (2013.01); *B65H 35/0086* (2013.01); *Y10T 83/6489* (2015.04)

(58) Field of Classification Search

CPC ..... B65H 35/02; B65H 35/0086; Y10T 83/6489

USPC ..... 270/5.03, 58.07

See application file for complete search history.

(56) References Cited

U.S. PATENT DOCUMENTS

| | | | | |
|---|---|---|---|---|
| 7,578,498 | B2 | 8/2009 | Iguchi et al. | |
| 7,650,823 | B2 | 1/2010 | Iguchi | |
| 7,740,238 | B2 * | 6/2010 | Iijima | B42B 4/00 270/32 |
| 7,744,074 | B2 | 6/2010 | Iguchi et al. | |
| 7,770,876 | B2 | 8/2010 | Sasahara | |
| 7,950,647 | B2 * | 5/2011 | Iguchi | B21D 28/26 270/58.07 |
| 7,954,797 | B2 * | 6/2011 | Sasahara | B31F 1/08 270/45 |
| 8,167,293 | B2 * | 5/2012 | Lewalski | B26D 7/0641 270/52.17 |
| 8,172,213 | B2 * | 5/2012 | Iguchi | B26D 5/32 270/58.02 |
| 8,916,028 | B2 * | 12/2014 | Ota | B65H 35/02 162/286 |
| 2010/0058907 | A1 * | 3/2010 | Kern | B26D 1/0006 83/86 |

* cited by examiner

*Primary Examiner* — Leslie A Nicholson, III

(74) *Attorney, Agent, or Firm* — Amin, Turocy & Watson LLP; Gregory Turocy

(57) ABSTRACT

In accordance with one embodiment, a paper processing apparatus comprises a perforation unit configured to include a rotary blade for perforating conveyed paper in a direction parallel to a conveyance direction and be capable of moving the rotary blade in a direction orthogonal to a conveyance path of the paper; a skew detection section configured at the upstream side of the perforation unit to detect the skew of the paper; a skew correction mechanism configured to incline the perforation unit and the rotary blade according to the detected skew amount of the paper; and a control section configured to control the position of the rotary blade and move the rotary blade to a perforation processing position before the paper is conveyed to the perforation unit.

10 Claims, 10 Drawing Sheets

PAPER PROCESSING APPARATUS

FIELD

Embodiments described herein relate generally to a paper processing apparatus for perforating paper discharged from an image forming apparatus.

BACKGROUND

Conventionally, an image forming apparatus such as a digital MFP (Multi-Function Peripheral), a copier, a printer and the like forms an image on paper and then discharge the paper. Further, a post processing apparatus (finisher) is arranged to be connected with a paper discharge section of the image forming apparatus main body to carry out post processing on the paper on which an image is formed. The post processing apparatus includes an apparatus which staples or perforates the paper.

For example, in a case of forming perforations in a direction parallel to a paper conveyance direction, a perforation processing position is set by a user, and the user moves a perforation cutter to the processing position. Further, the perforation cutter is fixed at an angle parallel to the paper conveyance direction.

However, the user has to adjust the position of the perforation cutter according to the paper size. Further, there is a case in which the paper conveyed to the post processing apparatus is inclined (hereinafter referred to as skew) with respect to the conveyance direction. If the paper is skewed, there is a disadvantage that the perforations are formed at positions different from the desired processing position.

DETAILED DESCRIPTION

Figure 1:
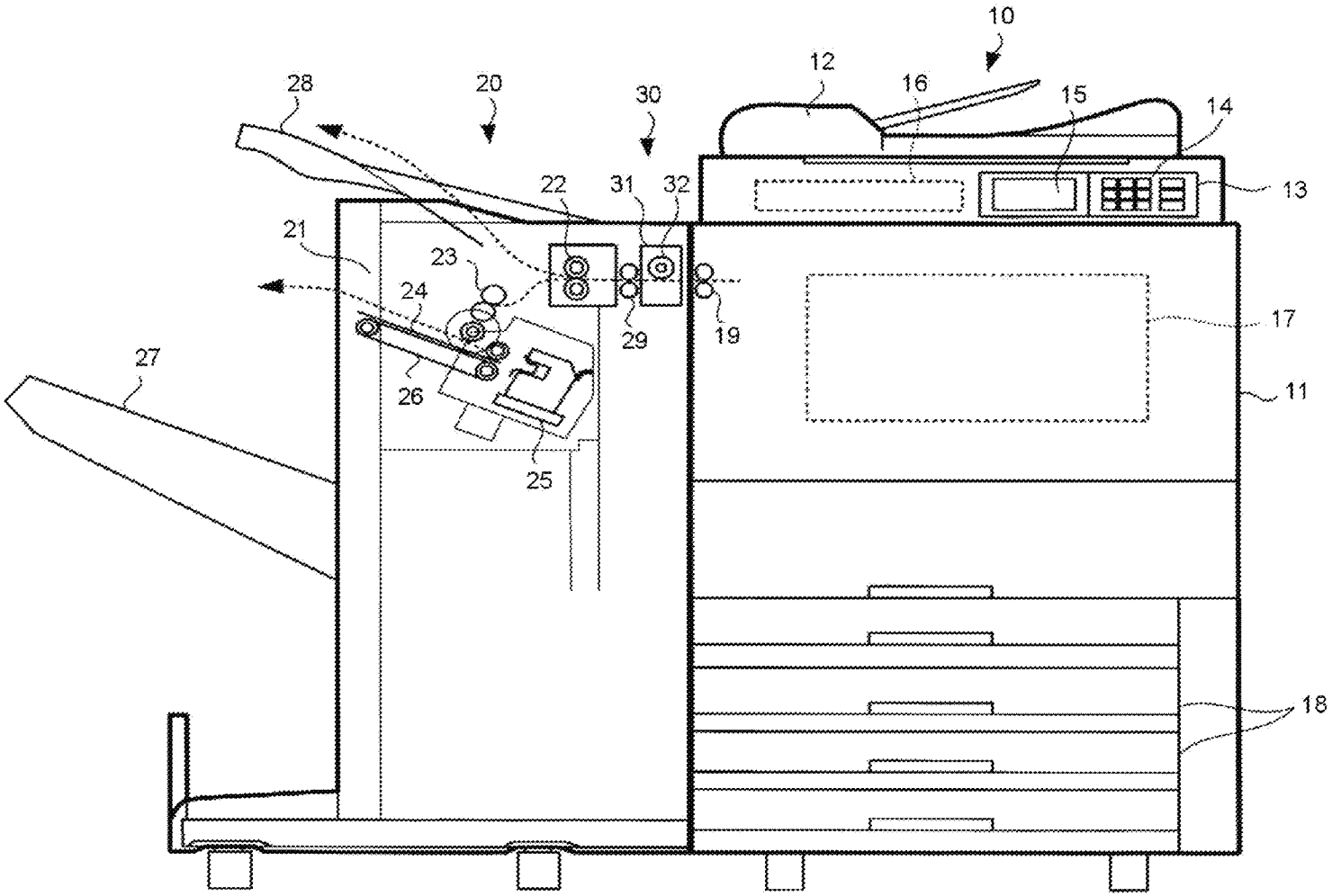
FIG. 1 is a constitution diagram illustrating a paper processing apparatus and an image forming apparatus according to one embodiment.

In accordance with one embodiment, a paper processing apparatus comprises a perforation unit configured to include a rotary blade for perforating conveyed paper in a direction parallel to a conveyance direction and be capable of moving the rotary blade in a direction orthogonal to a conveyance path of the paper; a skew detection section configured at the upstream side of the perforation unit of the conveyance path to detect the skew of the paper; a skew correction mechanism configured to incline the perforation unit and incline the rotary blade to an angle orthogonal to the front end of the paper according to the skew amount of the paper detected by the skew detection section; and a control section configured to control the position of the rotary blade and move the rotary blade to a perforation processing position before the paper is conveyed to the perforation unit.

Hereinafter, the paper processing apparatus according to the embodiment is described in detail with reference to the accompanying drawings. Same components in each figure are applied with the same reference numerals.

A First Embodiment

FIG. 1 is a constitution diagram illustrating the paper processing apparatus and an image forming apparatus according to one embodiment. In FIG. 1, an image forming apparatus 10 is a multi-function peripheral (MFP), a printer, a copier and the like. In the following description, the MFP is exemplified as the image forming apparatus.

The MFP 10 is provided with a document table (not shown) on the upper portion of a main body 11. An automatic document feeder (ADF) 12 is arranged on the document table in an openable manner. An operation panel 13 is arranged on the upper portion of the main body 11. The operation panel 13 is provided with an operation section 14 including various keys and a touch panel type display section 15.

The operation section 14 includes, for example, numeric keys, a reset key, a stop key, a start key and the like. The paper size, the number of copies and the like are designated through the touch panel type display section 15. Further, the setting of the processing position of a perforation by a finisher and the designation of stapling and the like can be carried out through the display section 15.

A scanner section 16 and a printer section 17 are arranged inside the main body 11. Further, a plurality of cassettes 18 for storing paper of various sizes are arranged at the lower portion of the main body 11. The scanner section 16 reads the document fed by the ADF 12 and the document placed on the document table.

The printer section 17 is provided with an image forming section including, for example, a photoconductive drum and a laser. The image forming section scans and exposes the surface of the photoconductive drum with the laser beam from the laser. An electrostatic latent image is formed on the photoconductive drum through the exposure. A charger, a developing device, a transfer device and the like are arranged around the photoconductive drum. The electrostatic latent image on the photoconductive drum is developed by the developing device to form a toner image on the photoconductive drum. The toner image is transferred to the paper by the transfer device.

Not limited to the example described above, the constitution of the printer section 17 may be of various types. A paper processing apparatus 20 is arranged to be connected with the main body 11 at the paper discharge side. The paper processing apparatus 20 is generally called as a finisher, and therefore, the paper processing apparatus 20 is referred to as a finisher 20 in the following description.

The paper on which an image is formed by the printer section 17 is conveyed to the finisher 20. The finisher 20 carries out post processing such as stapling processing and sorting processing on the paper fed from the MFP 10.

A perforation mechanism 30 for perforating the paper is arranged at the connection part of the finisher 20 and the MFP 10. The perforation mechanism 30 may be arranged in the finisher 20 or arranged separately from the finisher 20. The "perforation" in the present embodiment refers to a state in which holes are made in the paper at given intervals so that the paper can be torn easily.

The finisher 20 includes a stapling mechanism 21 for carrying out stapling processing on a paper bundle, and a paper discharge tray 27 or a fixed tray 28 to which the stapled paper bundle is discharged. The paper discharge tray 27, which is movable, receives the stapled paper bundle. The stapling mechanism 21 is provided with an alignment device for aligning the conveyed paper in a width direction. The paper can be sorted and discharged using the alignment device. In a case of not carrying out post processing, the paper conveyed from the MFP 10 is discharged to the paper discharge tray 27 or the fixed tray 28 directly.

The stapling mechanism 21 of the finisher 20 is briefly described below. An inlet roller 22 is arranged nearby a conveying-in port of the finisher 20. The paper fed from the MFP 10 via the perforation mechanism 30 is received by the inlet roller 22. At the downstream side of the inlet roller 22 are arranged a paper feed roller 23, a processing tray 24 and a stapler 25. The paper received by the inlet roller 22 is stacked on the processing tray 24 through the paper feed roller 23.

The paper stacked on the processing tray 24 is aligned by the alignment device in the width direction. The aligned paper is guided to the stapler 25 and stapled. A conveyance belt 26 is arranged to convey the stapled paper bundle to the paper discharge tray 27.

The paper stapled by the stapler 25 is discharged to the paper discharge tray 27 by the conveyance belt 26. The paper discharge tray 27 is lifted and lowered by a driving section (not shown) to receive the paper.

There is a case in which the paper is discharged to the paper discharge tray 27 directly without being subjected to the post processing. In this case, the paper is discharged directly without being dropped onto the processing tray 24. The paper that needs no post processing can be discharged to the fixed tray 28. A conveyance path (not shown) for guiding the paper to the fixed tray 28 is arranged.

Next, the perforation mechanism 30 is described. The perforation mechanism 30 is arranged between the MFP 10 and the stapling mechanism 21. The perforation mechanism 30 includes a perforation unit 31 and a rotary blade 32. The perforation unit 31 extends in a direction orthogonal to the paper conveyance direction. The rotary blade 32 perforates the paper in a direction parallel to the paper conveyance direction.

Further, a plurality of conveyance rollers 19 and 29 for conveying the paper are arranged on the path from the MFP 10 to the inlet roller 22. The conveyance roller 19 is arranged inside the MFP 10. The conveyance roller 29 is arranged at the outlet of the perforation mechanism 30. The paper discharged from the MFP 10 is conveyed to the perforation mechanism 30 by the conveyance roller 19 to be perforated. The perforated paper is conveyed to the stapling mechanism 21 by the conveyance roller 29.

The perforation unit 31 is activated when a user operates the operation panel 13 to set a perforation mode. Hereinafter, the constitution of the perforation mechanism 30 is described in detail with reference to FIG. 2.

Figure 2:
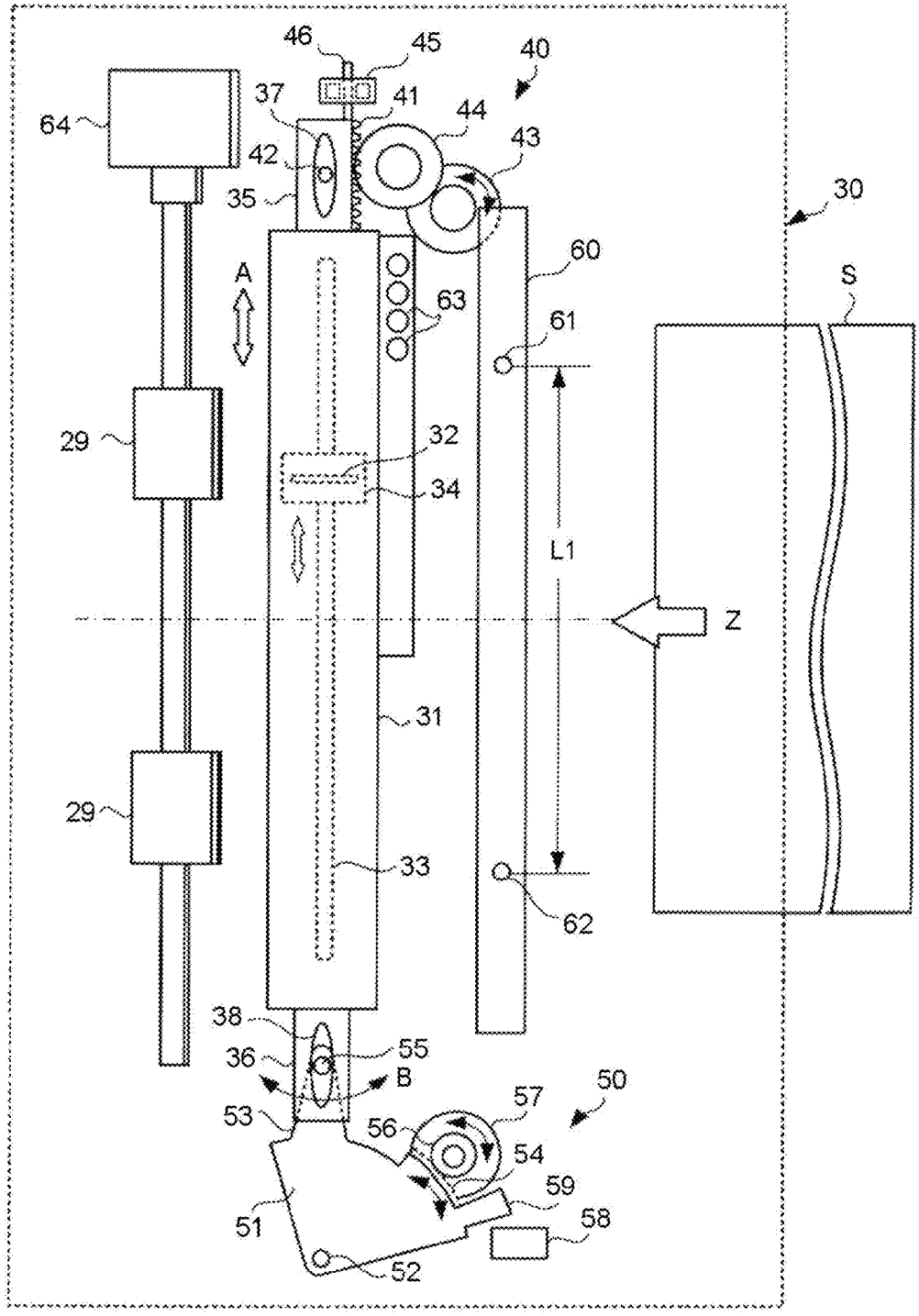
FIG. 2 is a plan view illustrating a perforation mechanism of the paper processing apparatus according to the embodiment.

In FIG. 2, the perforation mechanism 30 is provided with the perforation unit 31. The perforation unit 31 is arranged in a direction orthogonal to the paper conveyance direction. A feed screw 33 is arranged inside the perforation unit 31 in the longitudinal direction of the perforation unit 31. A moving body 34 is mounted on the feed screw 33. The moving body 34 moves along the feed screw 33.

The rotary blade 32 is rotatably supported in the moving body 34 in such a manner that the rotary blade 32 is parallel to the paper conveyance direction. Protruding pieces 35 and 36 are arranged at two ends in the longitudinal direction of the perforation unit 31. Long holes 37 and 38 are formed on the protruding pieces 35 and 36 along the longitudinal direction of the perforation unit 31.

The perforation unit 31 can be moved by a moving mechanism 40 in a direction (lateral direction) indicated by an arrow A orthogonal to the conveyance direction Z of the paper S. One end (lower end in FIG. 2) of the perforation unit 31 can be rotated in a given range by a skew correction mechanism 50 in a direction (longitudinal direction) indicated by an arrow B along the conveyance direction of the paper S.

That is, a rack 41 is formed at the lateral side of the protruding piece 35 arranged at one end of the perforation unit 31. A fixed shaft 42 arranged at the main body side of the finisher 20 is inserted into the long hole 37 of the protruding piece 35. Thus, the perforation unit 31 can be moved in the direction indicated by the arrow A in a range corresponding to the length of the long hole 37 with the fixed shaft 42 used as a guide.

The moving mechanism 40 includes a gear 44 which rotates in a state of meshing with the rack 41 and a motor 43 for rotating the gear 44. A sensor 45 is arranged at a given distance away from the protruding piece 35. A shutter 46 extending in the direction of the sensor 45 is arranged in the protruding piece 35. When the perforation unit 31 moves in the direction indicated by the arrow A and the shutter 46 crosses the sensor 45, the sensor 45 detects that the perforation unit 31 reaches a home position (hereinafter referred to as HP as occasion demands).

The skew correction mechanism 50 is provided with a fan-shaped cam 51 connected with the protruding piece 36 of the perforation unit 31. The cam 51, which rotates by taking a shaft 52 arranged at the main body side of the finisher 20 as a fulcrum, is provided with a lever 53 at one end and an arc gear 54 at the other end. A shaft 55 inserted into the long hole 38 of the protruding piece 36 is arranged on the lever 53.

Further, a gear 56 which rotates in a state of meshing with the gear 54 and a motor 57 for rotating the gear 56 are arranged. The cam 51 is rotated along with the rotation of the motor 57. The lever 53 is rotated when the cam 51 rotates. When the lever 53 is rotated, the protruding piece 36 of the perforation unit 31 is rotated through the shaft 55 arranged at the front end of the lever 53. Thus, the perforation unit 31 is rotated in the longitudinal direction (direction indicated by the arrow B) by taking the fixed shaft 52 as a fulcrum.

A sensor 58 is arranged at a given distance from the cam 51. The sensor 58 detects that the perforation unit 31 is rotated in the direction indicated by the arrow B to the home position. A shutter 59 extending in the direction of the sensor 58 is arranged in the cam 51. When the shutter 59 crosses the sensor 58, the sensor 58 detects that the perforation unit 31 is rotated to the home position.

A skew detection section 60 is arranged at the paper-conveying-in side of the perforation unit 31. That is, the perforation unit 31 is arranged at the downstream side of the skew detection section 60. Sensors 61 and 62 for detecting skew are arranged in the skew detection section 60. The sensors 61 and 62 are constituted by arranging, for example, a light-emitting element and a light-receiving element in an opposed manner. The paper S is passed through the space between the light-emitting element and the light-receiving element to detect the skew of the paper.

That is, the sensors 61 and 62 detect the passing of the front end of the conveyed paper S at the upstream side of the perforation unit 31. As shown in FIG. 2, the sensor 61 and the sensor 62 are arranged side by side in a direction orthogonal to the paper conveyance direction in such a manner that the two sensors are opposed to each other at a given distance L1.

A detection signal from the sensors 61 and 62 is sent to a later-described control section. The control section is provided with timer counters. The timer counters start to count time respectively when the sensors 61 and 62 detect the passing of the front end of the paper S. For example, in a case in which the paper S is not inclined in the conveyance direction, the sensors 61 and 62 detect the passing of the front end of the paper S at the same time. Thus, each timer counter starts to count time simultaneously, and time difference does not occur.

On the other hand, in a case in which the paper S is conveyed in an inclined manner due to the skew, difference occurs in the times when the sensors 61 and 62 detect the passing of the paper S. In this way, it can be detected that the paper S is skewed.

It is assumed that the paper S is inserted in a skewed manner, and detected by, for example, the sensor 61 first and then detected by the sensor 62. In this case, a skew error distance (a) is calculated according to a conveyance speed V and the difference in the times when the sensors 61 and 62 detect the passing of the paper. If the distance between the sensors 61 and 62 is set to L1 and the skew angle is (θ), the following formula (1) is established.

$$a = L1 \cdot \tan\theta \qquad \text{Formula (1)}$$

Thus, the skew angle θ can be calculated according to the formula (1). If the motor 57 is driven by a number of pulses so that the motor 57 is rotated for the angle θ, and the perforation unit 31 is inclined, the paper skew correction can be carried out.

Further, a sensor group 63 for detecting the end (lateral end) in the lateral direction of the paper S is arranged at the paper-conveying-in side of the perforation unit 31. The sensor group 63 consists of sensors **631-63*n* as described later. The sensors 631-63*n* arrange, for example, the light-emitting elements and the light-receiving elements in an opposed manner, and detect the end (that is, the lateral end) in the width direction of the paper S when the paper S passing through the space between the light-emitting elements and the light-receiving elements. The conveyance roller 29 arranged at the downstream side of the perforation unit 31 is driven by a motor 64**.

Figure 3A:
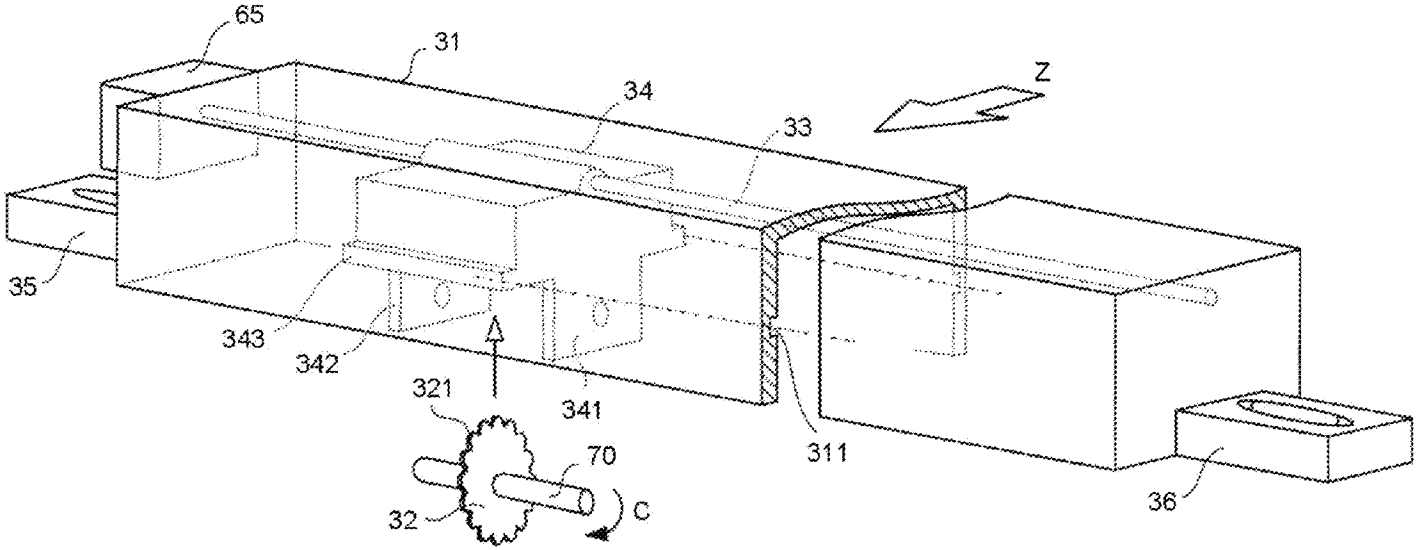
FIG. 3A-FIG. 3C are perspective views illustrating a perforation unit of the paper processing apparatus according to the embodiment.

Next, the perforation unit 31 is described in detail. FIG. 3A is a perspective view illustrating the perforation unit 31. One part is shown in a cross section in FIG. 3A. The perforation unit 31 is arranged in a direction orthogonal to the conveyance direction of the paper S. The perforation unit 31 is formed into a box shape the bottom of which is opened. A groove 311 is formed in the longitudinal direction at each lateral side of the perforation unit 31. The protruding pieces 35 and 36 are arranged at both ends of the perforation unit 31.

The feed screw 33 is rotatably installed in the longitudinal direction inside the perforation unit 31. A motor 65 is arranged at one end of the perforation unit 31 to rotate the feed screw 33. The moving body 34 is installed on the feed screw 33. When the feed screw 33, which is a spiral-shaped groove, is rotated, the moving body 34 is moved along the feed screw 33.

Supporting parts 341 and 342 extending downwards (towards the surface direction of the conveyed paper S) are arranged in the moving body 34. The supporting parts 341 and 342 support the rotary blade 32 in a rotatable manner. In FIG. 3A, for the sake of convenience of description, the rotary blade 32 is shown in a state of being separated from the moving body 34.

That is, the rotary blade 32 is arranged around the outer periphery of a rotation shaft 70 which is rotatably supported by the supporting parts 341 and 342. That is, the rotary blade 32 is supported by the supporting parts 341 and 342 in the manner of being parallel to the paper conveyance direction Z. The peripheral surface of the rotary blade 32 includes, for example, saw-tooth notches 321. The rotary blade 32 is not integrally fixed on the rotation shaft 70, in other words, the rotary blade 32 is installed in a free manner without being regulated, thus, the rotary blade 32 is rotated along with the conveyance of the paper S to perforate the paper S.

A protrusion 343 is formed at each lateral side of the moving body 34. The protrusion 343 is fitted into the groove 311 formed at each lateral inner side of the perforation unit 31. Thus, the moving body 34 moves in the longitudinal direction by taking the groove 311 as a guide. In addition, it is exemplified that the feed screw 33 is used to move the moving body 34, however, other mechanism than the feed screw 33 may be used as long as it can move the moving body 34 in the longitudinal direction of the perforation unit 31.

Figure 3B:
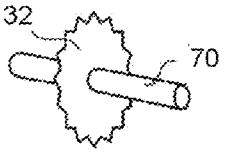

As shown in FIG. 3B, the rotary blade 32 may include saw-tooth blade on the circumference. The rotary blade 32 may include blades arranged at given pitch intervals. Further, it is exemplified that the rotary blade 32 rotates along the conveyance of the paper S, however, the rotary blade 32 itself may be rotated.

Figure 3C:
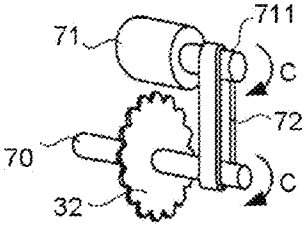

FIG. 3C is a diagram illustrating an example in which the rotary blade 32 is rotated by a motor 71. In FIG. 3C, the motor 71 is arranged in the moving body 34, and a belt 72 is stretched between a shaft 711 of the motor 71 and the rotation shaft 70. When the motor 71 is rotated, the rotation shaft 70 is rotated through the belt 72. Thus, the rotary blade 32 is rotated as well. A rotation direction C of the rotary blade 32 is such a direction that encourages the conveyance of the paper. In other words, the rotation direction C of the rotary blade 32 is the same as the conveyance direction of the paper.

Figure 4A:
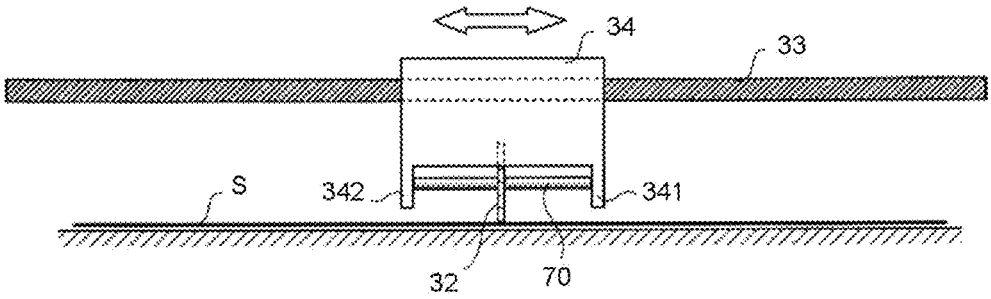
FIG. 4A and FIG. 4B are side views and plan views illustrating a perforation processing operation carried out by the perforation unit according to the embodiment.
Figure 4B:
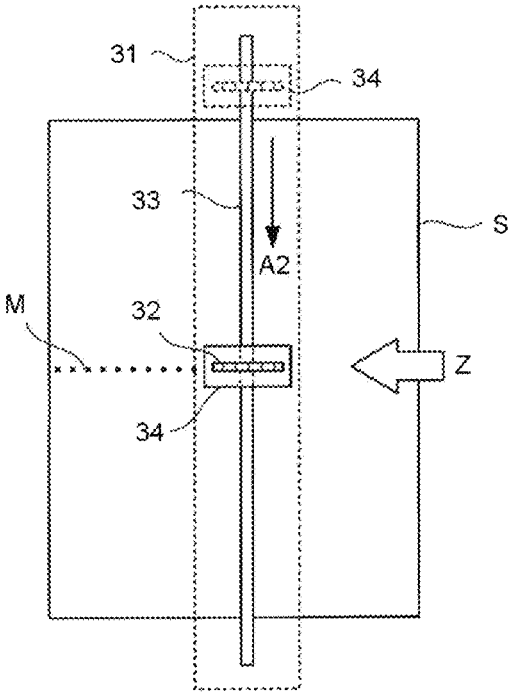

FIG. 4A and FIG. 4B are diagrams illustrating the perforation operation of the perforation unit 31. FIG. 4A is a diagram viewed from the side of the path where the paper S passes through the perforation unit 31. FIG. 4B is a plan view illustrating the perforation operation.

As shown in FIG. 4A and FIG. 4B, the moving body 34 of the perforation unit 31 is generally located at a retracting position indicated by dotted lines. The moving body 34 is moved in a direction indicated by an arrow A2 to a perforation processing position along with the conveyance of the paper S. When the paper S is conveyed, the rotary blade 32 rotates to form perforation M in the paper S. In addition, FIG. 4A and FIG. 4B show a state in which the paper S is not skewed.

Figure 5:
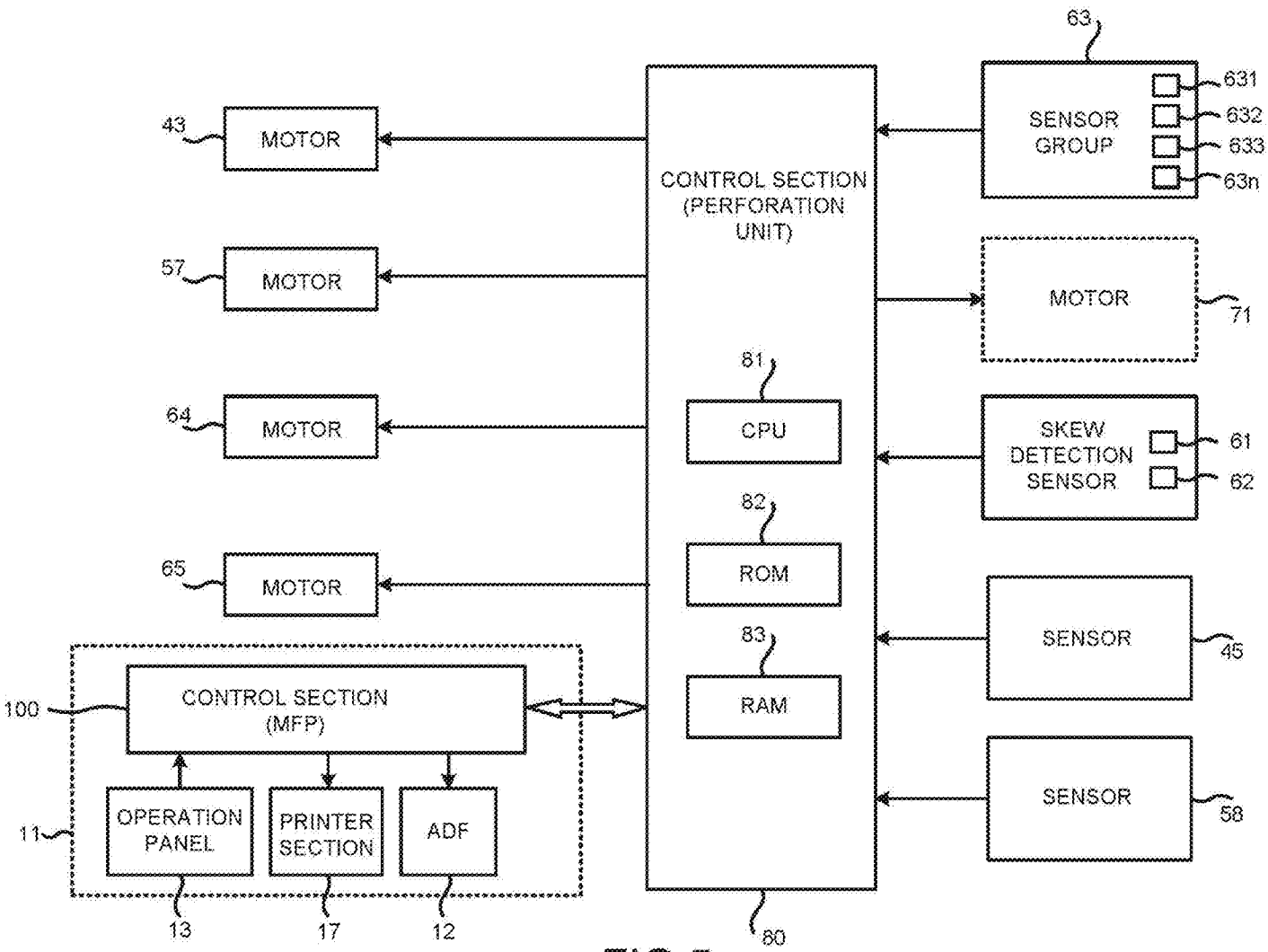
FIG. 5 is a block diagram illustrating a control system of the perforation mechanism according to the embodiment.

Next, the control system for driving the perforation mechanism 30 is described with reference to FIG. 5. FIG. 5 is a block diagram illustrating the control system of the perforation mechanism.

In FIG. 5, a control section 80 for controlling the perforation unit 31 and a control section 100 for controlling the MFP 10 are provided. The control section 80 includes a CPU (Central Processing Unit) 81, an RAM 82, an ROM 83 and the like. The CPU 81 controls the whole operations of the perforation mechanism 30. The ROM 82 stores control programs and the like. The RAM 83 temporarily stores data when the CPU 81 carries out various processing.

The control section 80 is connected with the skew detection sensors 61 and 62, the sensor group (the plurality of sensors 631-63*n*) for detecting the lateral end of the paper S, and the home position detection sensors 45 and 58. The sensor 45 detects the home position when the perforation unit 31 is moved by the motor 43 in the lateral direction (direction A). The home position in the lateral direction of the perforation unit 31 is the center part of the conveyance path of the paper S. The sensor 58 detects the home position when the perforation unit 31 is moved by the motor 57 in the longitudinal direction (direction B). The home position in the longitudinal direction is the position where the perforation unit 31 is inclined the most. The detection result from each sensor is input to the control section 80.

The control section 80 is further connected with the motor 43, the motor 57, the motor 64, the motor 65 and the motor 71. The control section 80 controls the rotation of each motor in response to the detection results of the various sensors described above.

The motor 43 moves the perforation unit 31 in the lateral direction (direction A). The motor 57 rotates the cam 51 to move the perforation unit 31 in the longitudinal direction (direction B). The motor 64 drives the conveyance roller 29 to rotate. The motor 65 rotates the feed screw 33 to move the moving body 34. The motor 71 rotates the rotary blade 32 shown in FIG. 3C.

Further, the control section 80 is connected with the control section 100 for controlling the MFP 10. The control section 100 is connected with each section (for example, the operation panel 13, the printer section 17, the ADF 12 and the like) of the MFP 10. The control section 80 and the control section 100 operate in conjunction with each other to instruct the perforation position and designate the paper size through the operation of the operation panel 13, and in response, the perforation unit 31 executes the conveyance, skew correction, perforation processing of the paper S.

Next, the operation of the perforation unit 31 in a case in which the paper S is conveyed in a state of being inclined from the regular conveyance state is described.

Figure 6A:
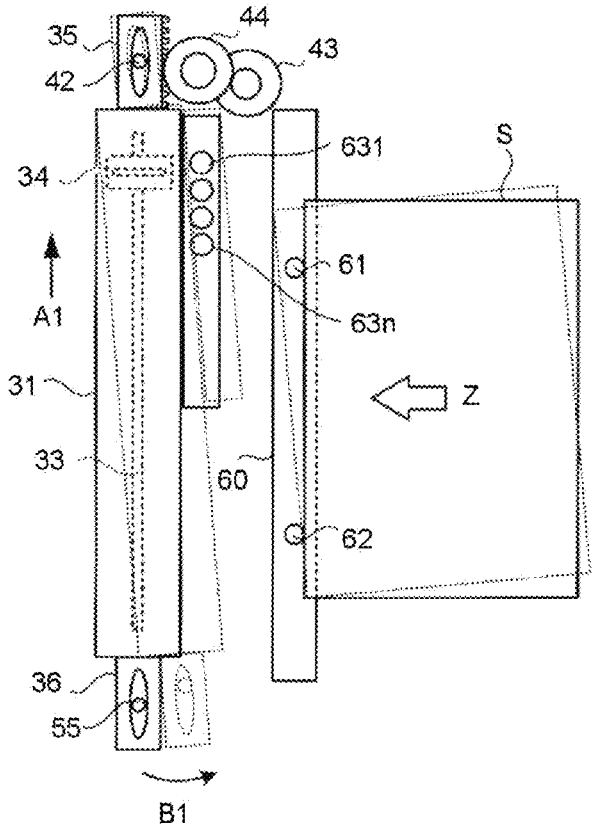
FIG. 6A and FIG. 6B are illustration diagrams illustrating the basic operation of the perforation mechanism according to the embodiment.
Figure 6B:
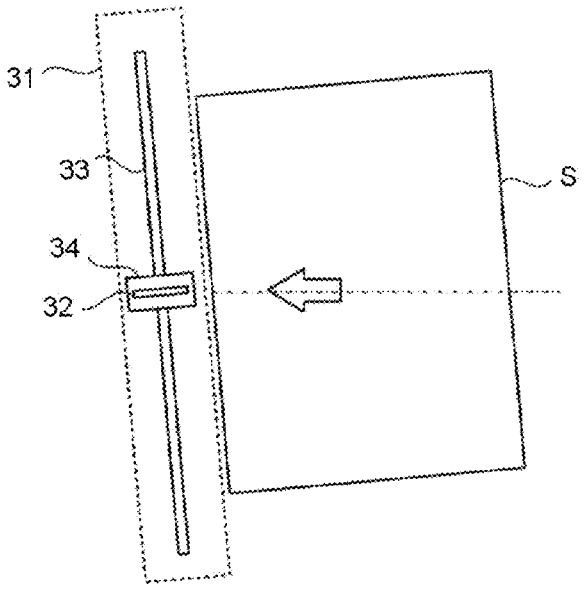

FIG. 6A and FIG. 6B are illustration diagrams illustrating the basic operation of the perforation mechanism 30. In FIG. 6A, when an instruction indicating to "perforate the paper" is received from the MFP 10, the control section 80 drives the motor 57. The perforation unit 31 is rotated in a direction indicated by an arrow B1 along the paper conveyance direction and set in an inclined state indicated by dotted lines. In this state, the perforation unit 31 is located at the home position in the longitudinal direction.

Then the control section 80 drives the motor 43 to rotate the gear 44. The perforation unit 31 is moved, through the rotation of the gear 44, in the direction indicated by the arrow A1 orthogonal to the conveyance direction of the paper S and set at the retracting position. The moving body 34 is also shifted by the motor 65 in the direction indicated by the arrow A1 to the retracting position.

Sequentially, when the paper S is conveyed, the skew of the front end of the paper S is detected by the skew detection section 60. After the skew detection section 60 detects the skew amount, the control section 80 drives the motor 57 to rotate and incline the perforation unit 31 in response to the skew amount of the conveyed paper S.

The solid line in FIG. 6A indicates a case in which the paper S is not skewed. In this case, as shown by the solid line, the perforation unit 31 is controlled at an angle orthogonal to the conveyance direction of the paper S. The dotted line in FIG. 6A indicates a case in which the paper S is skewed. In this case, as shown by the dotted line, the perforation unit 31 is inclined according to the skew amount.

FIG. 6B is a diagram schematically illustrating a state in which the paper S is skewed and the perforation unit 31 is inclined according to the skew amount. Before the paper S is conveyed to the perforation unit 31, the control section 80 drives the motor 65 to move the moving body 34 to move the rotary blade 32 to the perforation position. The position of the perforation is set by the user by operating the operation panel 13. Thus, the control section 80 can move the moving body 34 to the perforation position on the basis of the information from the control section 100. In a case in which the paper S is skewed, the perforation unit 31 is inclined according to the skew amount, thus, the rotary blade 32 is inclined to an angle orthogonal to the front end of the paper S. The moving body 34 waits until the paper S is conveyed to the perforation processing position.

Incidentally, in a case in which the paper S is not set in the cassette 18 correctly, or in a case in which the paper S is skewed, the paper S is conveyed in a state of being shifted from the regular conveyance state. For example, the paper S is conveyed in a state of being shifted in the width direction from the regular position or conveyed in a skewed state. Thus, even if the moving body 34 is moved to the perforation processing position, the perforation cannot be formed at the correct position if the paper S is shifted.

Thus, in the present embodiment, the end in the width direction of the paper S is detected by the lateral end detection sensors 631-63*n*, and the position of the perforation unit 31 is corrected according to the deviation based on the detection results. Any of the sensors 631-63*n* is designated according to the paper size instructed through the operation panel 13, and the detection of the lateral end by the sensors 631-63*n* is determined according to the detection result of the designated sensor.

Figure 7A:
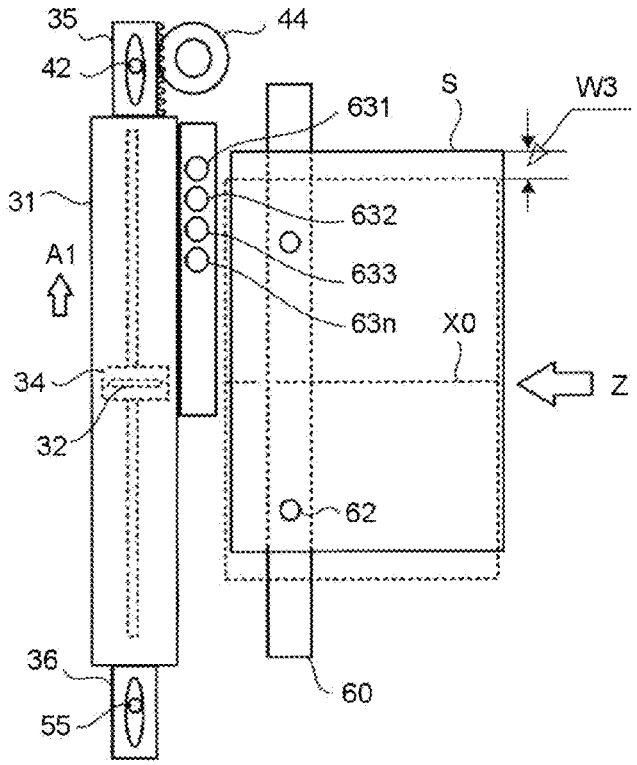
FIG. 7A and FIG. 7B are illustration diagrams illustrating the control of the moving body when paper is conveyed in a shifted state according to the embodiment.
Figure 7B:
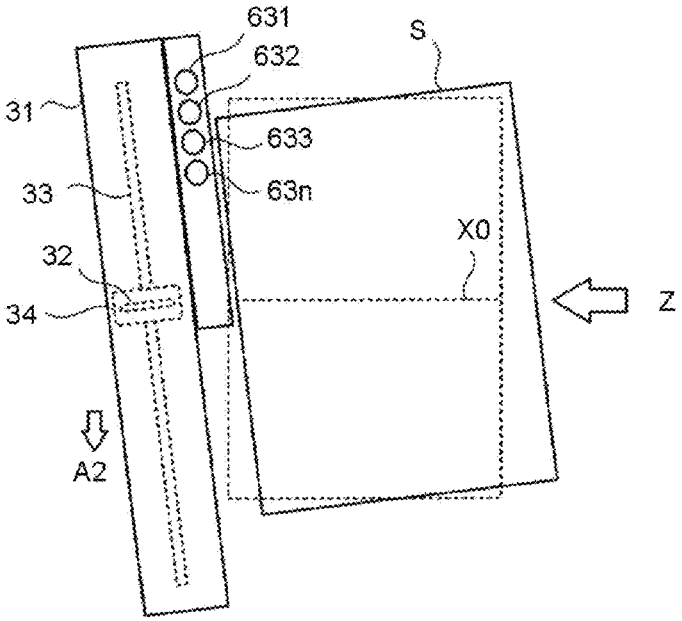

FIG. 7A and FIG. 7B are illustration diagrams illustrating the control of the moving body 34 in a case in which the paper S is conveyed in a state of being shifted from the regular conveyance state. FIG. 7A is a diagram illustrating a state in which the paper S is conveyed in a state of being shifted in the upper direction in FIG. 7A from the regular position (indicated by dotted line). For example, if the perforation processing position in a case in which A4-sized paper is conveyed at the regular position is X0, the moving body 34 waits at a position corresponding to the processing position X0. When the paper S passes through the regular position, the passing of the paper S is detected by, for example, the sensor 632, 633 and 63*n* within the sensors 631-63*n*, while the sensor 631 does not detect the passing of the paper S.

However, in a case in which the paper S is conveyed in a state of being shifted in the upper direction as shown by the solid line, all the sensors 631-63*n* detect the passing of the paper S. That is, in a case of the A4-sized paper, the sensor 631, which is supposed not to detect the passing of the paper S, detects the passing of the paper S, thus, the CPU 81 determines that the paper S is shifted upwards for a width (width W3) equal to one sensor.

Thus, the CPU 81 moves the perforation unit 31 upwards (in the direction indicated by the arrow A1) for the width of one sensor. That is, the perforation unit 31 is moved to a position where the passing of the paper S cannot be detected by the sensor 631. Thus, the perforation can be formed at the regular position.

FIG. 7B is a diagram illustrating a state in which the paper S is conveyed in a state of being skewed with respect to the regular position (indicated by the dotted line). When the paper S is conveyed in a state of being skewed, the sensors 633 and 63*n* within the sensors 631-63*n* detect the passing of the paper S, while the sensors 631 and 632 do not detect the passing of the paper S. That is, the sensor 632, which is supposed to detect the passing of the paper S, does not detect the passing of the paper S, thus, the CPU 81 determines that the paper S is shifted downwards for a width equal to one sensor.

Thus, the CPU 81 moves the perforation unit 31 downwards (in the direction indicated by the arrow A2) for the width of one sensor. That is, the perforation unit 31 is moved to a position where the passing of the paper S can be detected by the sensor 632. Thus, the perforation can be formed at the regular position.

Further, in a case in which the conveyed paper is skewed, the perforation unit 31 is inclined according to the skew amount, thus, the rotary blade 32 is inclined to an angle orthogonal to the front end of the paper S.

Figure 8A:
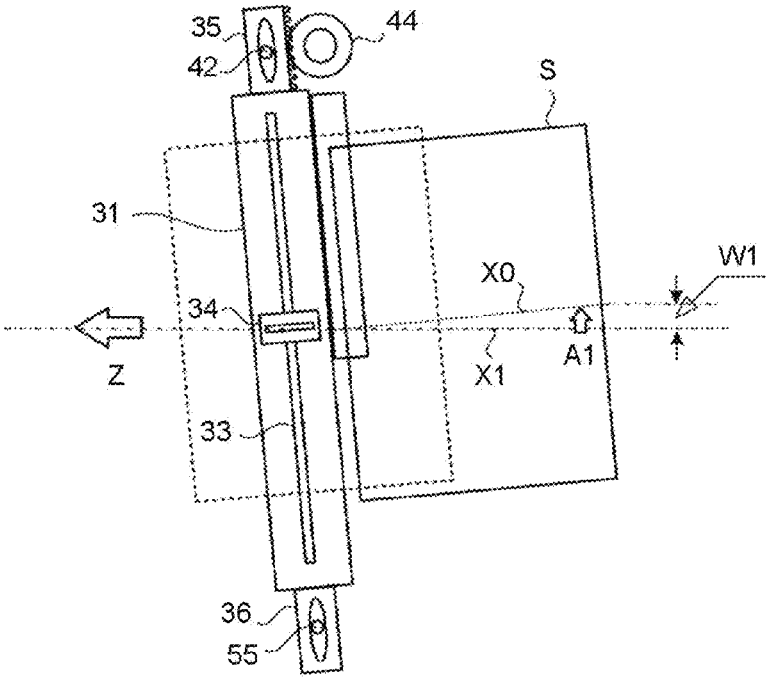
FIG. 8A and FIG. 8B are illustration diagrams illustrating the control of the moving body when paper is skewed according to the embodiment.
Figure 8B:
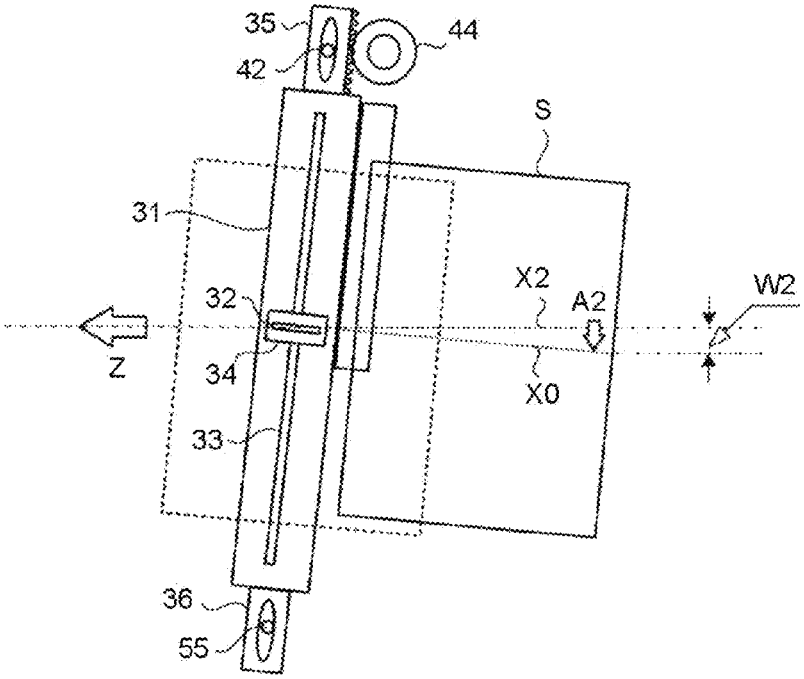

FIG. 8A and FIG. 8B are illustration diagrams illustrating the control of the moving body 34 in a case in which the paper S is skewed. In a case in which the paper S is skewed, the perforation unit 31 is inclined according to the skew amount. However, as shown in FIG. 8A, the paper S is conveyed in a state of being skewed as shown by the solid line and the dotted line.

FIG. 8A shows a state in which the paper S is inclined anticlockwise with respect to the conveyance direction. Thus, if the moving body 34 perforates the paper at the fixed position as it is, the perforations are formed in the paper along the position indicated by a one dotted line X1 shown in FIG. 8A. Thus, the perforations are formed in the paper at positions which are shifted downwards little by little from the original perforation processing position (indicated by the dotted line X0). The position is shifted downwards for an amount indicated by a width W1 at the time when the rear end of the paper S reaches the perforation unit 31.

Thus, in the present embodiment, the position of the moving body 34 is finely adjusted according to the angle of the skew. That is, in the example shown in FIG. 8A, when the front end of the paper S reaches the perforation unit 31, the processing start position where the perforation processing is just started is taken as the reference position, and the moving body 34 is gradually moved in the direction A1 (upwards) during a period before the rear end of the paper S reaches the perforation processing completion position. Thus, the perforations can be formed at the original perforation processing position (indicated by the dotted line X0), and deviation can be prevented.

On the contrary, as shown in FIG. 8B, in a state in which the paper S is inclined clockwise with respect to the conveyance direction, the perforations are formed in the paper along the position indicated by a one dotted line X2 shown in FIG. 8B. Thus, the perforations are formed in the paper at positions which are shifted upwards little by little from the original perforation processing position (indicated by the dotted line X0). The position is shifted upwards for an amount indicated by a width W2 at the time when the rear end of the paper S reaches the perforation unit 31.

Thus, in a case of FIG. 8B, when the front end of the paper S reaches the perforation unit 31, the processing start position where the perforation processing is just started is taken as the reference position, and the moving body 34 is gradually moved in the direction A2 (downwards) during a period before the rear end of the paper S reaches the perforation processing completion position.

The position of the moving body 34 is finely adjusted by controlling the rotation amount of the motor 65 by the CPU 81. The CPU 81 shifts the moving body 34 stepwise according to the conveyance speed V of the paper S, the width (paper size) of the paper S from the front end to the rear end and the skew amount θ. Further, the moving direction of the moving body 34 is changed according to the inclination direction of the paper S. If the skew amount increases, the deviation (W1 or W2) becomes larger, and the moving amount of the moving body 34 from the processing start position increases as well.

In this way, the rotary blade 32 can form perforations correctly at the set perforation processing position.

In addition, though it is exemplified in the description above that the position of the moving body 34 is finely adjusted by controlling the rotation amount of the motor 65 by the CPU 81, the present invention is not limited to this.

For example, the rotary blade 32 may be installed in advance on the rotation shaft 70 in the free manner, that is, in a non-regulated state, and moves along with the conveyance of the paper S. That is, after the moving body 34 is moved to the perforation processing start position through the rotation of the motor 65, the rotary blade 32 in the free state moves along with the conveyance of the paper S, in this way, the perforation processing position is finely adjusted. Thus, the perforations can be formed correctly in the paper at the preset perforation processing position.

A Second Embodiment

There is a problem that in the post processing apparatus according to the first embodiment described above, the perforations cannot be formed correctly into a straight line in the processing of perforating the paper if the paper conveyed to the perforation unit is deflected at the perforation processing position. The post processing apparatus according to the second embodiment can solve the problem. In the following description in the second embodiment, the same constitution as that in the first embodiment described above is not described repeatedly.

Figure 9A:
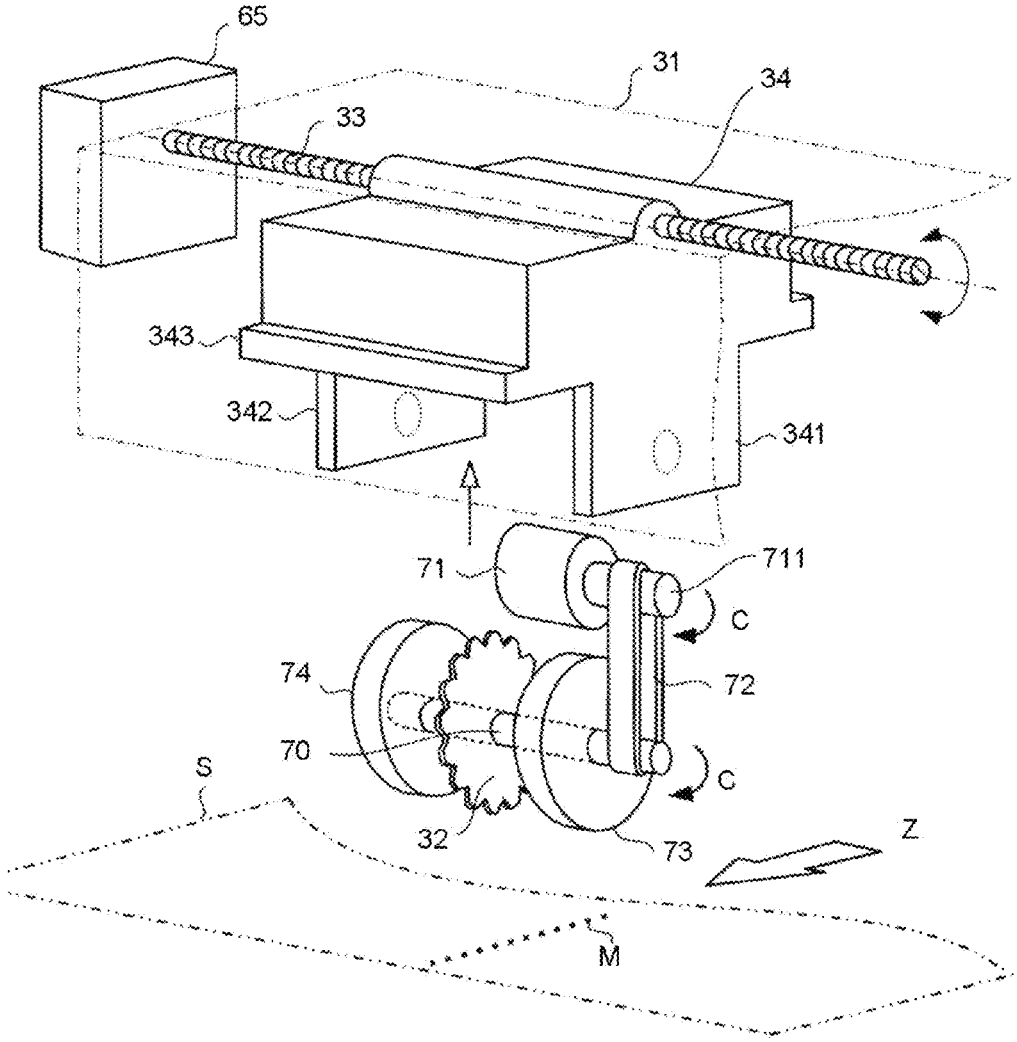
FIG. 9A and FIG. 9B are perspective views illustrating an auxiliary mechanism of a rotary blade in the paper processing apparatus according to a second embodiment.

FIG. 9A is a perspective view illustrating an auxiliary mechanism of the rotary blade 32 in the paper processing apparatus according to the second embodiment.

In the first embodiment, the rotary blade 32 is installed on the shaft 70 as a single body. In the second embodiment, rollers 73 and 74 are arranged at two sides of the rotary blade 32 at a preset distance from each other. The rollers 73 and 74, which serve as pressing members for pressing the paper S when the rotary blade 32 perforates the paper S, assist the perforation processing.

In FIG. 9A, the perforation unit 31 includes the moving body 34 installed on the feed screw 33 and the motor 65 for rotating the feed screw 33. When the feed screw 33 is rotated, the moving body 34 moves along the feed screw 33. Further, the moving body 34 includes the supporting parts 341 and 342 extending downwards (towards the surface direction of the conveyed paper S).

The rotary blade 32 is arranged around the outer periphery of the rotation shaft 70. The rollers 73 and 74 serving as the pressing members are arranged at two sides of the rotary blade 32 on the rotation shaft 70. Two ends of the rotation shaft 70 are rotatably supported by the supporting parts 341 and 342. In FIG. 9A, for the sake of convenience of description, the rotary blade 32 and the rollers 73 and 74 are shown in a state of being separated from the moving body 34.

Further, the motor 71 is arranged in the moving body 34, and the belt 72 is stretched between the shaft 711 of the motor 71 and the rotation shaft 70. When the motor 71 is rotated, the rotation shaft 70 is rotated through the belt 72. Thus, the rotary blade 32 and the rollers 73 and 74 are rotated as well. The rotation direction C of the rotary blade 32 and the rollers 73 and 74 is such a direction that encourages the conveyance of the paper S.

The diameter of the rotary blade 32 is a little larger than that of the rollers 73 and 74. When the paper S is conveyed, the rotary blade 32 and the rollers 73 and 74 are rotated by the motor 71. The perforation M is formed in the paper S through the rotation of the rotary blade 32.

Figure 9B:
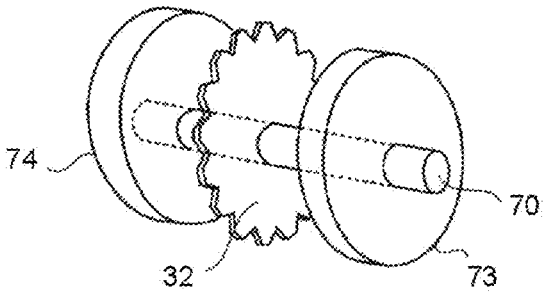

FIG. 9B is a perspective view illustrating another form of the rotary blade 32 and the rollers 73 and 74. In FIG. 9B, there is no motor 71, and the rotary blade 32 and the rollers 73 and 74 rotate freely on the shaft 70. Thus, when the paper S is conveyed, the rotary blade 32 and the rollers 73 and 74 are driven to rotate through the conveyance of the paper S. Perforations are formed in the paper S through the rotation of the rotary blade 32.

Figure 10A:
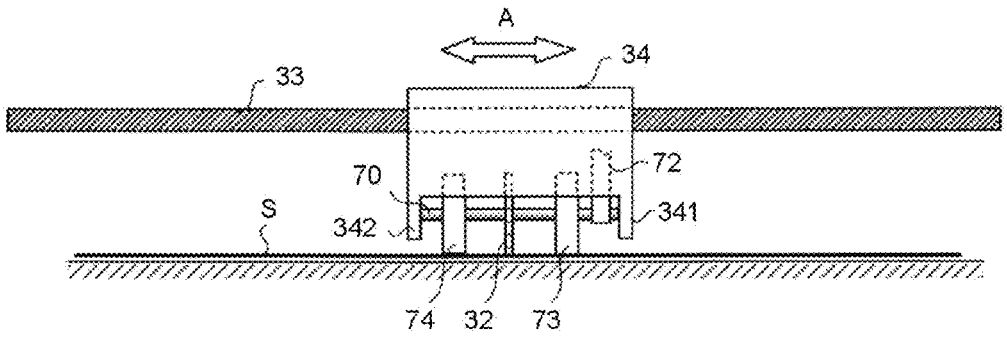
FIG. 10A and FIG. 10B are side views illustrating a perforation processing operation carried out by a perforation unit in the second embodiment.
Figure 10B:
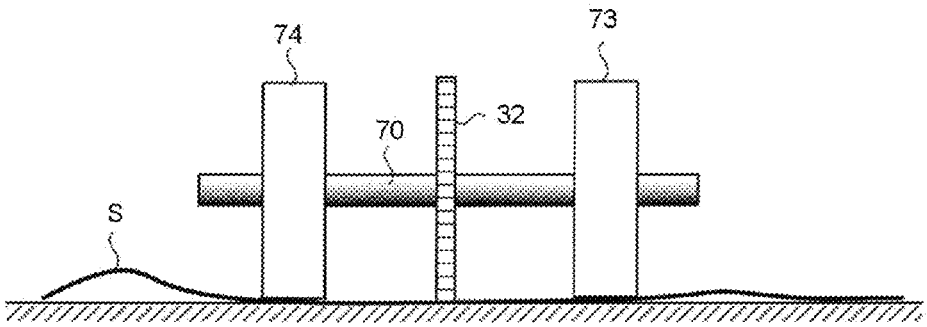

FIG. 10A and FIG. 103 are side views illustrating the perforation processing operation carried out by the perforation unit 31 shown in FIG. 9A (or FIG. 9B). FIG. 10A and FIG. 10B are viewed from the side of the path where the paper S passes through the perforation unit 31.

As shown in FIG. 10A, the moving body 34 of the perforation unit 31 moves to the perforation processing position along with the conveyance of the paper S. when the paper S is conveyed, the motor 71 is rotated and the rotation is transferred to the rotary blade 32 through the belt 72. When the rotary blade 32 is rotated, the perforation M is formed in the paper S. Further, the rollers 73 and 74 arranged at the two sides of the rotary blade 32 press the paper S.

FIG. 10B is an enlarged side view illustrating the operation of the rotary blade 32 and the rollers 73 and 74. There is a case in which the perforations cannot be formed correctly into a straight line if the paper S is deflected due to the flapping of the paper S and the like. In the worst case, the paper S is stuck by the blade of the rotary blade 32 and damaged. Alternatively, the rotary blade 32 is bent or damaged.

Thus, as shown in FIG. 10B, the rollers 73 and 74 for pressing the paper S are arranged at the two sides of the rotary blade 32. The paper S positioned between the rollers 73 and 74 does not flap, thus, correct perforation can be formed by the rotary blade 32.

In accordance with the embodiments described above, correct perforation can be formed even if the conveyed paper is shifted from the regular conveyance state or if the paper is deflected.

It is exemplified in the description above that the perforation mechanism 30 is arranged inside the finisher 20, however, the finisher 20 and the perforation mechanism 30 may be arranged separately from each other. Further, it is exemplified that the finisher 20 and the MFP 10 are arranged separately from each other, however, the finisher including the perforation mechanism 30 may be arranged inside the main body 11 of the MFP 10.

Furthermore, it is exemplified that the perforation mechanism 30 perforates the paper output from the main body 11 of the MFP 10, however, an inserter may also be used. The paper may be conveyed to the perforation mechanism 30 in sequence through the inserter, and then perforated by the perforation mechanism 30.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A paper processing apparatus, comprising:

a perforation unit configured to include a rotary blade for perforating conveyed paper in a direction parallel to a conveyance direction and be capable of moving the rotary blade in a direction orthogonal to a conveyance path of the paper;

a skew detection section configured at the upstream side of the perforation unit of the conveyance path to detect the skew of the paper;

a skew correction mechanism configured to incline the perforation unit and incline the rotary blade to an angle orthogonal to the front end of the paper according to the skew amount of the paper detected by the skew detection section; and a control section configured to control the position of the rotary blade and move the rotary blade to a perforation processing position before the paper is conveyed to the perforation unit.

2. The paper processing apparatus according to claim 1, wherein the rotary blade is rotated through the conveyance of the paper to perforate the paper.

3. The paper processing apparatus according to claim 1, further comprising:

a motor configured to rotate the rotary blade; wherein the rotary blade is rotated in such a direction that encourages the conveyance of the paper to perforate the paper.

4. The paper processing apparatus according to claim 1, wherein the perforation unit includes the rotary blade and a moving body which supports the rotary blade and moves in a direction orthogonal to the conveyance path.

5. The paper processing apparatus according to claim 1, wherein the control section controls to move the rotary blade to a perforation processing start position according to the perforation processing position, and controls to gradually move the rotary blade according to the skew amount detected by the skew detection section and the skew direction during a period when the paper is conveyed from the perforation processing start position to the perforation processing completion position.

6. The paper processing apparatus according to claim 1, further comprising:

a moving mechanism configured to move the whole perforation unit in a direction orthogonal to the conveyance path; wherein the control section controls, in a case in which the paper is conveyed in a state of being shifted from a regular conveyance state, the moving mechanism to move the perforation unit to a position for correcting the deviation.

7. The paper processing apparatus according to claim 6, wherein the perforation unit further includes a sensor group for detecting the end in the width direction of the conveyed paper; and the control section controls the moving mechanism to move, in a case in which the position in the width direction of the paper detected by the sensor group is shifted from the regular conveyance state, the perforation unit according to the deviation of the paper.

8. The paper processing apparatus according to claim 1, further comprising:

pressing members configured at both sides of the rotary blade to press the paper.

9. The paper processing apparatus according to claim 8, wherein the pressing members are rollers which are installed on a rotation shaft on which the rotary blade is installed, and are rotated by a motor together with the rotary blade.

10. The paper processing apparatus according to claim 8, wherein the pressing members are rollers which are installed on a rotation shaft on which the rotary blade is installed, and are driven to rotate through the conveyance of the paper.

* * * * *